US006363532B1

(12) United States Patent
Miller et al.

(10) Patent No.: US 6,363,532 B1
(45) Date of Patent: Apr. 2, 2002

(54) RIFLE SLING SUPPORT

(76) Inventors: Mark W. Miller, 3450 Hayden Bridge Dr., Springfield, OR (US) 94747; Rick Barron, 70 1A Catlen Way, Sacramento, CA (US) 95831

( * ) Notice: Subject to any disclaimer, the term of this patent is extended or adjusted under 35 U.S.C. 154(b) by 0 days.

(21) Appl. No.: 09/330,307

(22) Filed: Jun. 11, 1999

(51) Int. Cl.[7] ..... A41D 1/04; F41C 33/00

(52) U.S. Cl. ..... 2/102; 2/94; 224/149; 224/913

(58) Field of Search ..... 2/102, 94, 247, 2/69, 250; 224/149, 150, 913

(56) References Cited

U.S. PATENT DOCUMENTS 4,964,553 A * 10/1990 Glynn ..... 224/149
5,664,721 A * 9/1997 Homeyer ..... 224/149 X
5,669,170 A * 9/1997 Norris ..... 224/150 X
5,991,925 A * 11/1999 Wu ..... 2/102

* cited by examiner

*Primary Examiner*—Peter Nerbun

(57) ABSTRACT

A rifle sling support for securing a rifle to the back of a user. An engagement portion is adapted to engage an intermediate extent of the rifle. The engagement portion is supported upon a nylon webbing. The webbing has a first end, a second end, and an intermediate extent therebetween. The first and second ends of the webbing have fastening means secured thereto. The webbing is ad pted to be disposed about a belt with the fastening means of the first end releasably engaging the fastening means of the second end. A grip and stock with retaining element has a first elongated end and a second arcuate portion defined by a curvature. The elongated end is secured to the webbing. The arcuate portion has upper and lower edges. The grip and stock retaining element is entirely formed from a malleable metal.

1 Claim, 4 Drawing Sheets

FIG 3
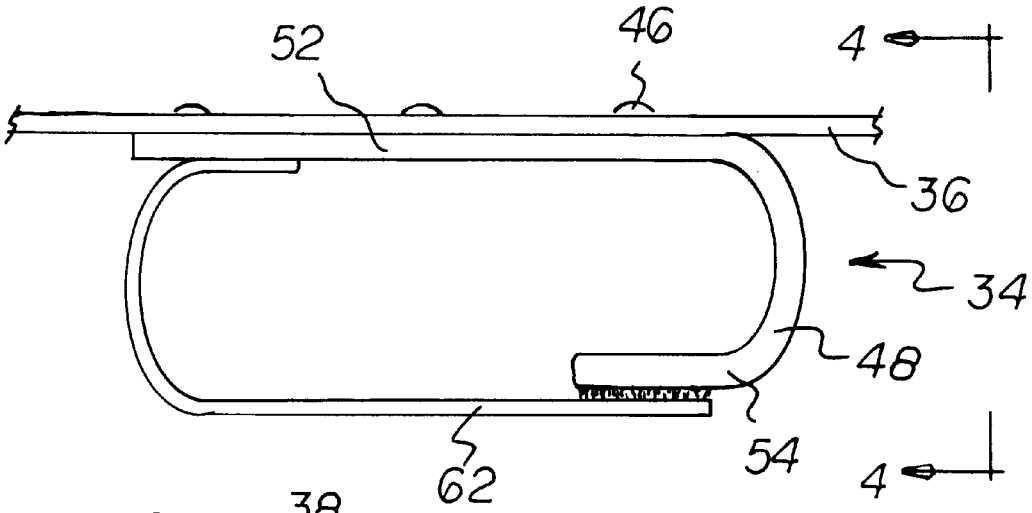
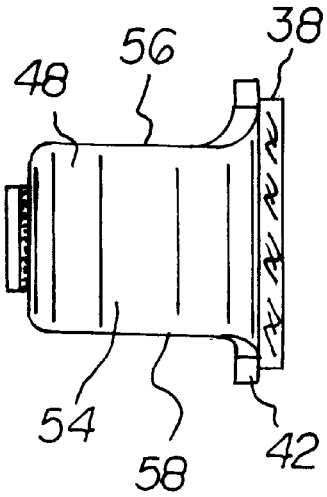
FIG 4
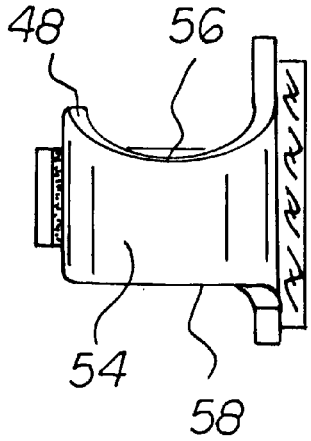
FIG 5
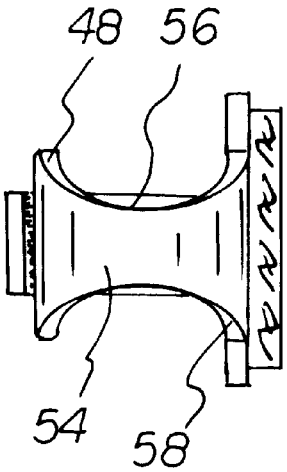
FIG 6

FIG 9
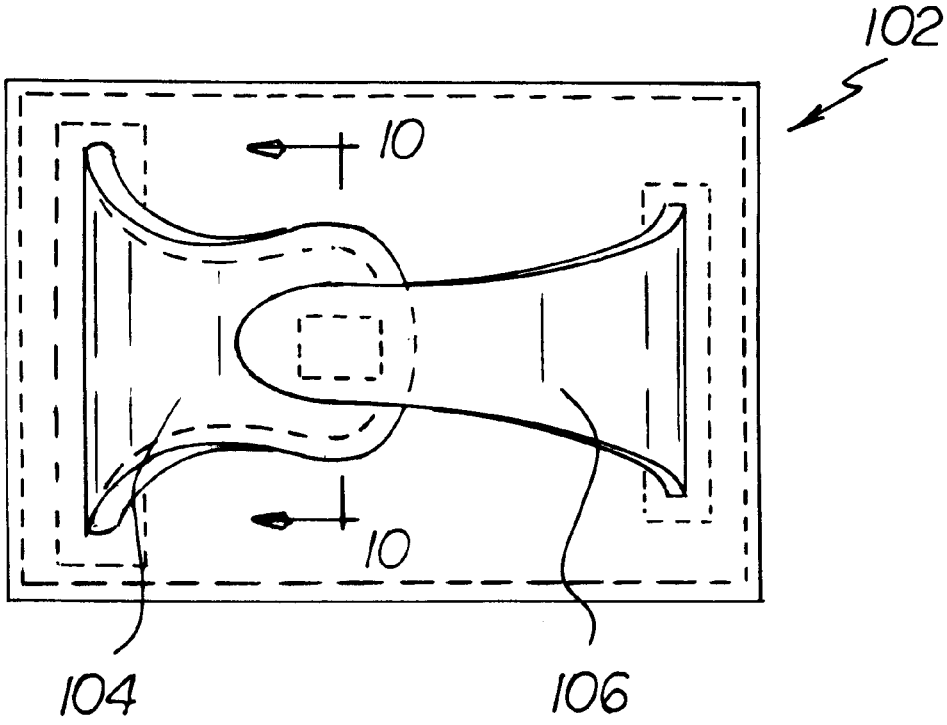
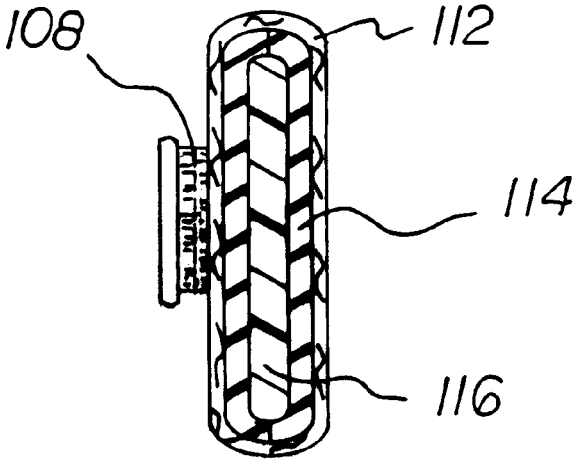
FIG 10

RIFLE SLING SUPPORT

BACKGROUND OF THE INVENTION

1. Field of the Invention

The present invention relates to a new and improved support for a rifle and, more particularly, pertains to such a support which can be worn upon a user's back.

2. Description of the Prior Art

The prior art discloses a large number of gun support devices. By way of example, U.S. Pat. No. 2,543,703 to Pelto discloses a gun support employing a strap and socket member. U.S. Pat. No. 3,963,156 to Perrin discloses a gun rest cradle which is adapted to be worn about the waist of a user. U.S. Design Pat. No. 162,904 illustrates a belt attaching gun cradle. U.S. Pat. No. 4,662,552 to Uyehara discloses a baton holder for law enforcement officers. Lastly, U.S. Pat. No. 5,664,721 to Homeyer discloses a backpack-style firearm/bow/fishing rod carrier. None of these prior art references discloses a belt mounted support which secures the rifle adjacent to the spine of a user. Additionally, none carriers of the prior art give a user ready access to his or her rifle. Furthermore, prior carriers are not specifically adapted to secure rifles of varying makes and models.

In this respect, the rifle sling support of the present invention substantially departs from the conventional concepts and designs of the prior art, and in doing so provides an apparatus developed primarily to give a user easy access to a back mounted rifle. Additionally, the present invention provides a sling support wherein rifles of varying makes and models can be accommodated.

SUMMARY OF THE INVENTION

In view of the foregoing disadvantages inherent in the known types of gun carriers now present in the prior art, the present invention provides a new and improved rifle sling support. As such, the general purpose of the present invention, which will be described subsequently in greater detail, is to provide a new and improved rifle support which enables a user ready access to a back mounted rifle. Additionally, the rifle sling support of the present invention allows a user to modify the support to accommodate rifles of differing makes and models.

To attain this, the present invention essentially comprises a new and improved rifle sling support for securing a rifle to the back of a user. The support has, as its first major component, a nylon belt. The nylon belt has a first end, a second end, and an intermediate extent therebetween. The first end of the belt has an impact-resistant plastic securement means attached thereto. The second end of the belt is adapted to be removably received within the securement means of the first end. The second major component of the rifle sling support comprises an engagement portion. The engagement portion is adapted to engage an intermediate extent of the rifle. The engagement portion is supported upon a nylon webbing, the webbing having a first end, a second end, and an intermediate extent therebetween. The first end of the webbing has male snap fasteners secured thereto, and the second end of the webbing has female snap fasteners secured thereto. The webbing is disposed about the intermediate extent of the nylon belt with the male snap fasteners being removably secured to the female snap fasteners such that the engagement portion can be slidably positioned along the intermediate extent of the nylon belt. The third major component of the rifle sling support is a grip and stock with retaining element. This element has a first elongated end and a second arcuate portion defined by a curvature. The elongated end is secured to the webbing. The arcuate portion has upper and lower edges, the upper edge adapted to support the pistol grip of the rifle, the lower edge adapted to engage the lower stock of the rifle. The upper edge has a first radius of curvature and the lower edge has a second radius of curvature with the first radius of curvature being twice that of the second radius of curvature. The grip and stock retaining element is entirely formed from a malleable metal which is completely covered by vinyl, the malleability of the grip and stock retaining element allowing a user to rotate the second arcuate portion with respect to the webbing as well as adjust the curvature of the second arcuate portion.

Lastly, provided as a component of the rifle sling apparatus, is a safety strap having a first end, a second end with an intermediate extent therebetween. The first end is secured to the webbing and the second end is adapted to be releasably secured to the second arcuate portion of the grip and stock retaining element.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a rifle sling support which allows a user ready access to a back mounted rifle.

It is a further object of the present invention to provide a rifle sling support which can be modified to allow for use in conjunction with rifles of varying makes and models.

It is another object of the present invention to provide a rifle sling support in the form of a vest which affords a user a wide range of movement while still supporting a back mounted rifle.

An even further object of the present invention is to provide a new and improved rifle sling support which is susceptible of a low cost of manufacture with regard to both materials and labor, and which accordingly is then susceptible of low prices of sale to the consuming public, thereby making such a rifle sling support economically available to the buying public.

Lastly, it is an object of the present invention to provide a rifle sling support for securing a rifle to the back of a user. An engagement portion is adapted to engage an intermediate extent of the rifle. The engagement portion is supported upon a nylon webbing. The webbing has a first end, a second end, and an intermediate extent therebetween. The first and second ends of the webbing have fastening means secured thereto. The webbing is adapted to be disposed about a belt with the fastening means of the first end releasably engaging the fastening means of the second end. A grip and stock with retaining element has a first elongated end and a second arcuate portion defined by a curvature. The elongated end is secured to the webbing. The arcuate portion has upper and lower edges. The grip and stock retaining element is entirely formed from a malleable metal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view taken along line 3—3 of FIG. 2.

FIG. 4 is a left side elevational view of one engagement portion for use with the present invention.

FIG. 5 is a right side elevational view of another engagement portion of the present invention.

FIG. 6 is a right side elevational view of still yet another engagement portion of the present invention.

FIG. 9 is a plan view of an alternative embodiment of the rifle retaining element.

FIG. 10 is a sectional view of the rifle retaining element.

The same reference numerals refer to the same parts throughout the various Figures.

DESCRIPTION OF THE PREFERRED EMBODIMENT

With reference now to the drawings, and in particular to FIGS. 1 through 8 thereof, the preferred embodiments of the new and improved rifle sling support embodying the principles and concepts of the present invention will be described.

The present invention relates to a support whereby a user can easily and securely retain a rifle upon his or her back. The invention finds particular application in conjunction with hunting and practice shooting or for other situations where an individual may need ready access to a firearm but, at the same time, need his or her hands free for various other activities. In its broadest context, the support of the present invention includes one or more retaining elements which are adapted to be positioned along an intermediate extent of a rifle such that the rifle is secured along a user's back proximate to the spine. The support can be used in conjunction with a belt adapted to be worn about the waist of a user. Alternatively, the support can be combined into a vest which the user can wear when employing the support. Additionally, the support of the present invention can be used upon a rifle or shotgun or any other elongated firearm. Furthermore, the support of the present invention can be used in conjunction with a firearm that has a strap or other such conventional securing means. The various details of the present invention, and the manner in which they interrelate, will be described in greater detail hereinafter.

Figure 1:
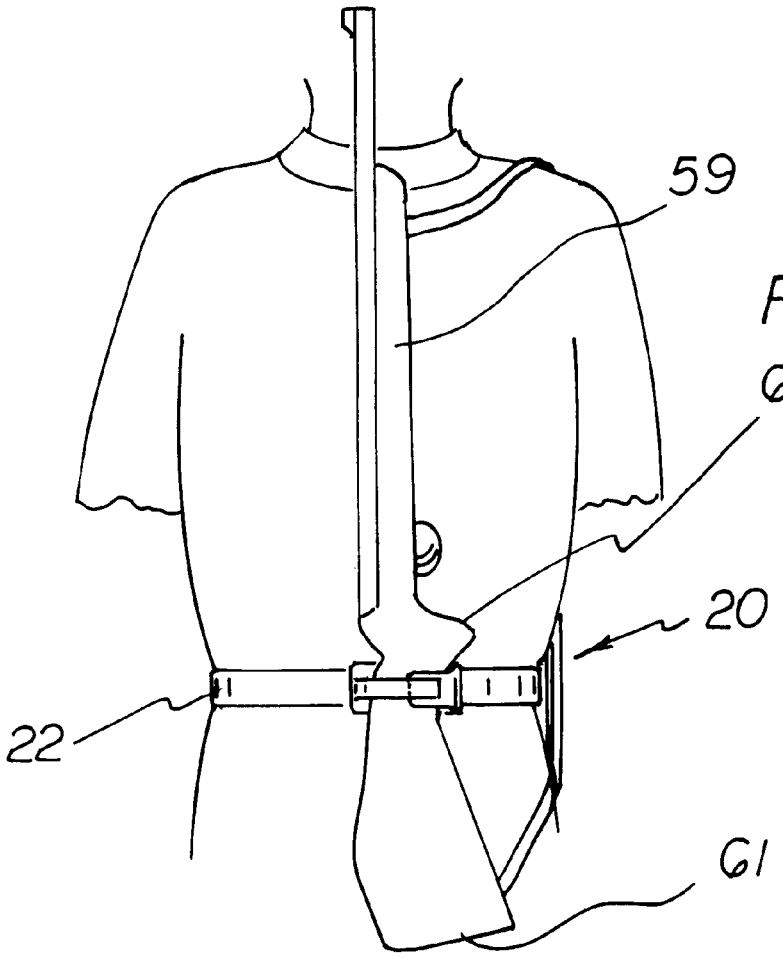
FIG. 1 is a front elevational view of the preferred embodiment of the present invention shown in use with a rifle secured to the back of a user.
Figure 2:
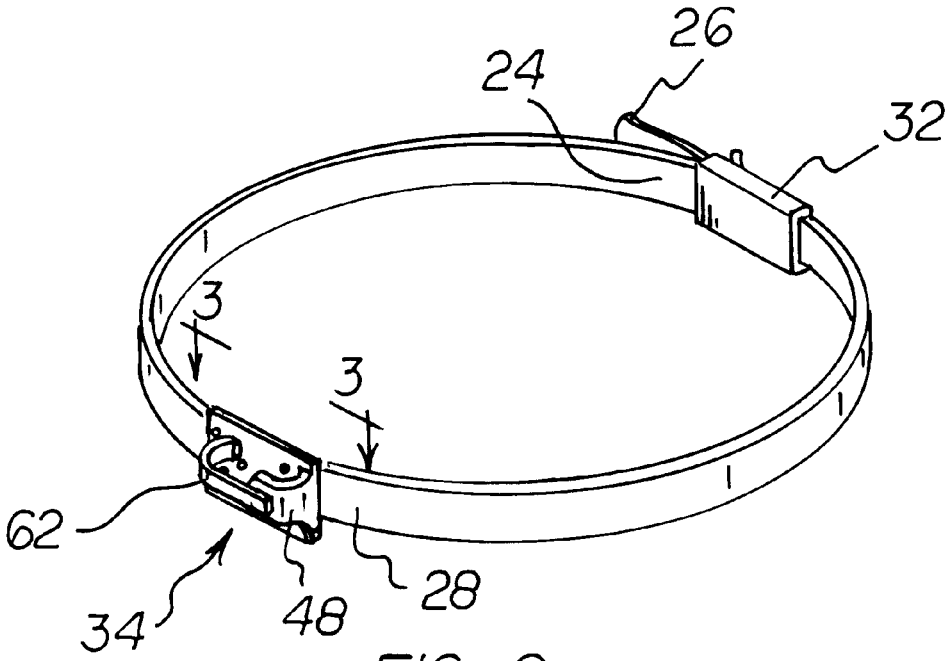
FIG. 2 is a perspective view of the apparatus of the present invention.

The primary embodiment 20 of the intention is illustrated with reference to FIG. 1. This embodiment has the supporting device of the present invention slidably interconnected along the length of the belt 22. In the preferred embodiment the belt 22 is formed entirely from nylon and furthermore is defined by a first end 24 and a second end 26 and an intermediate extent 28 therebetween. To facilitate securing this belt 22 about the waist of a user, the first end 24 includes a securement means 32. Such securement means 32 is adapted to removably receive within it the second end 26 of the belt 22. The second end 26 can be secured within the securing means 32 in any one of a number of positions to facilitate the adjustability of the belt 22. In the preferred embodiment, this securement means 32 is formed from an impact-resistant plastic. As indicated, an engagement portion 34 is adapted to be slidably positioned along the intermediate extent 28 of the nylon belt 22. To facilitate this, the engagement portion 34 is entirely supported upon a length of webbing 36. In the preferred embodiment, this webbing 36 is formed from nylon and is defined by a first end 38, a second end 42 and an intermediate extent therebetween. Furthermore, the first end 38 of the webbing 36 has a series of male snap fasteners 44 secured within it through stitching or other such means. Likewise, the second end 42 of the webbing 36 has female snap fasteners 46 secured in a similar fashion. The webbing 36 is of a sufficient length to encircle the width of the belt 22. Thus, a user may dispose the webbing 36 about the belt 22 and thereafter secure the male snap fasteners 44 into the female snap fasteners 46. In this manner, the web 36 is secured about and slidably related to the belt 22. Although snap fasteners have been described as the preferred embodiment, other such fasteners which are known in the art could also be employed for this function such as Velcro fasteners and the like.

The primary component of the engagement portion is a grip and stock retaining element 48. This element is most clearly seen with reference to FIGS. 3 through 6 and can take any one of a variety of shapes. The shape of this grip and stock retaining element 48 forms an important component of the present invention. This retaining element 48 is defined by an elongated first end 52 and an arcuate second end 54 or portion. The arcuate portion 54 is defined by a radius of curvature, note FIG. 3. The elongated end 52 is adapted to be secured to the webbing 36. This securement is preferably achieved by sewing the elongated end 52 into the nylon webbing 36. However, other securing means can be utilized such as adhesives or fasteners. The arcuate portion 54 is primarily defined by upper and lower edges 56 and 58 respectively. These edges play an important role in supporting the rifle. More specifically, when a rifle 59 with a pistol grip 60 is supported, the upper edge 56 must be of a suitable contour or shape. In a similar fashion, the lower edge 58 is shaped or contoured to support the lower stock 61 of a rifle 59. Thus, the various contours for the upper and lower edges (56 and 58) depicted in FIGS. 4 through 6 illustrate the various configurations utilized to support rifles of various makes or models. In one such embodiment, note FIG. 6, the upper edge 56 has a first radius of curvature and the lower edge 58 has a second radius of curvature, wherein the first radius of curvature is twice that of the second radius of curvature. Both of the embodiments in FIGS. 5 and 6 are constructed to accommodate a rifle 59 with a pistol grip 60. Alternatively, FIG. 4 is for use in conjunction with a rifle 59 having neither a pistol grip 60 nor a substantial stock 61.

Furthermore, whichever embodiment of the grip and stock retaining element 48 is employed, a user may make further modifications in order to insure that the retaining element 48 precisely and adequately supports his or her make or model of rifle. To accomplish this, the grip and stock retaining element 48, as well as the entire engagement portion 34, is formed from a malleable metal. The metal is chosen such that it can be manipulated through manual force applied by the user under standard conditions. Thus the malleability of the grip and stock retaining element 48 allows a user to rotate the second arcuate portion 54 of the retaining element with respect to the elongated first end 52. Likewise, the malleability allows a user who supplies sufficient manual force to adjust the curvature of the second arcuate portion 54. Thus the opening formed by the curvature of the second arcuate portion 54, note FIG. 3, can be adjusted to accommodate the specific needs of a user. Furthermore, the entire engagement portion 34 including the grip and stock retaining element is covered from a vinyl material. This vinyl material prevents a rifle 59 from becoming nicked or otherwise marred from engaging the support of the present invention.

As an optional component of the engagement portion of the present invention, a safety strap 62 may be-included, Such safety strap 62 is illustrated with reference to FIG. 3. This strap 62 is defined by first and second ends with an intermediate extent therebetween. The first end is adapted to be secured to the webbing through stitching and the like. The second end is adapted to be releasably secured to the second arcuate portion 54 of the grip and stock retaining element 48. The safety strap 62 functions in insuring that the firearm does not become dislodged from the engagement portion 34. However, the safety strap 62 is an optional feature and the engagement portion with its grip and stock retaining element 48 under normal conditions are sufficient to retain the rifle 59. The safety strap 62 can employ any one of a number of securing means whereby the second end is releasably secured to the arcuate portion 54. This means include a hook, a snap, or pile-type fasteners.

Figure 7:
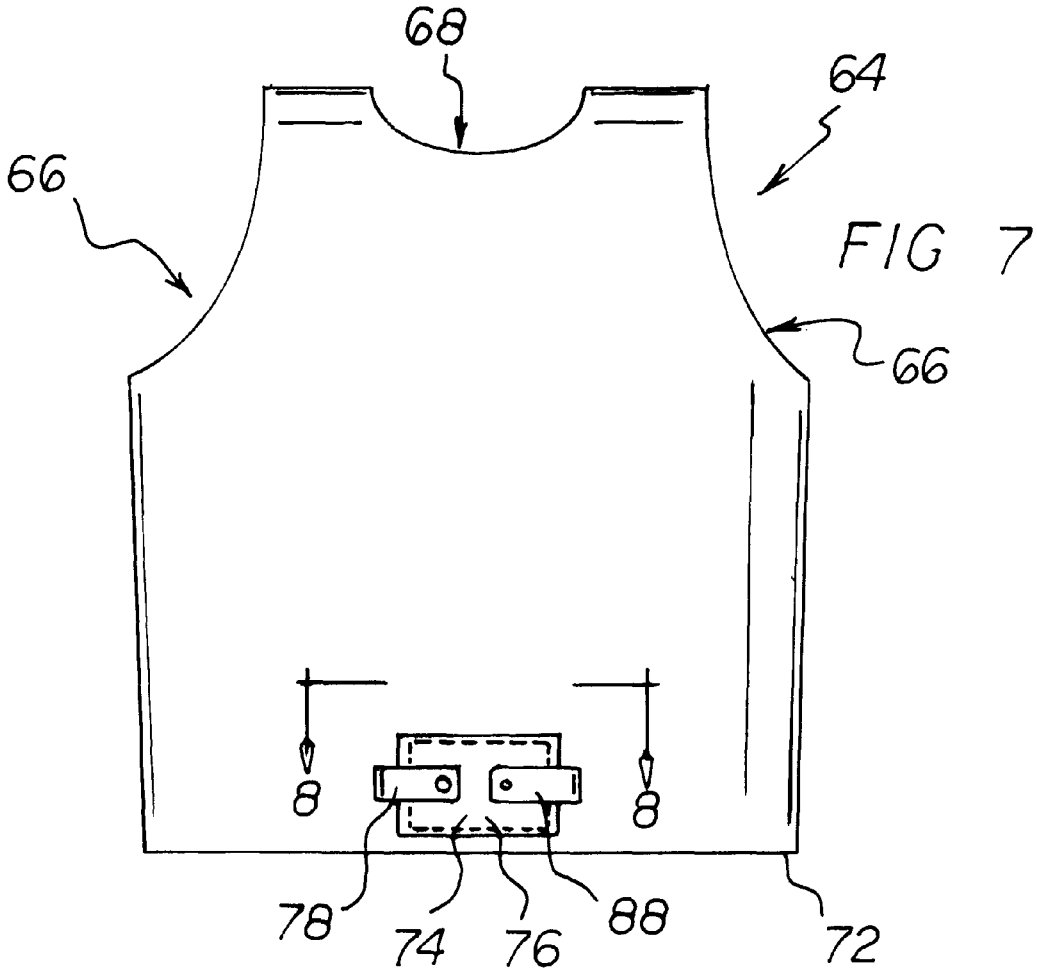
FIG. 7 is a rear elevational view of an alternate embodiment of the present invention with the rifle retaining apparatus sewn to a garment.
Figure 8:
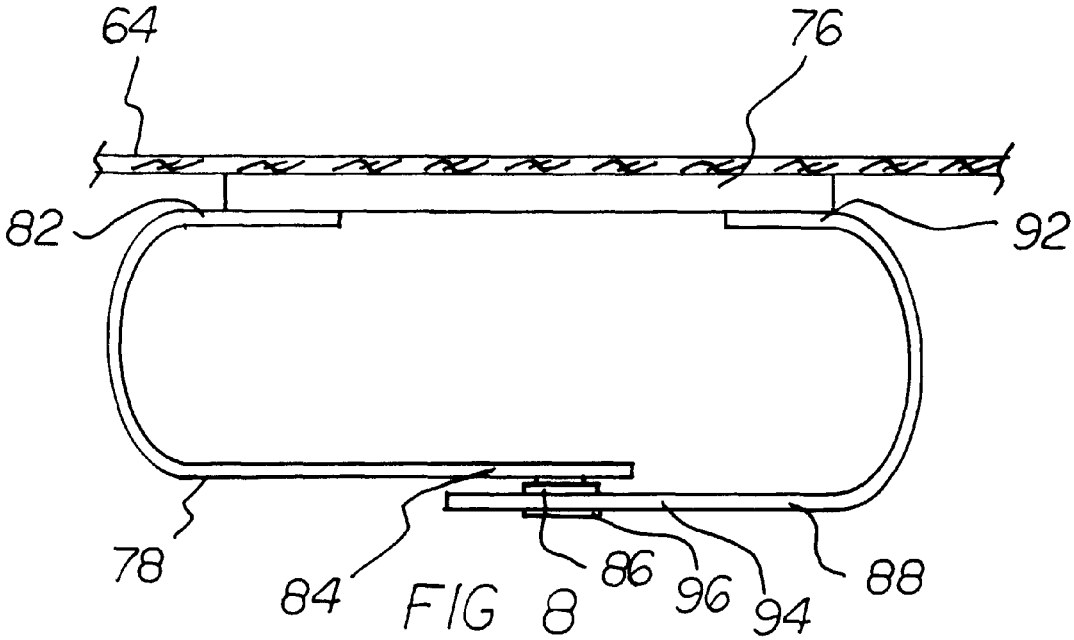
FIG. 8 is a top elevational view of the rifle-retaining apparatus taken at line 8—8 of FIG. 7.

The second embodiment of the present invention is illustrated with reference to FIG. 7. This embodiment finds particular application for supporting the rifle upon the back of a user who is engaged in an athletic activity such as downhill snow skiing or cross country skiing or running. This embodiment includes a vest portion 64 which is adapted to be secured about the torso of a user. The vest 64 has a lower peripheral extent and an upper extent with two armholes 66 and a neck opening 68. The vest 64 further includes a front with a zipper or other closure means and a back. The vest of this embodiment is adapted to support a rifle retaining element 74 at the lower back portion of a user. This rifle-retaining element 74 comprises a rectangular base 76 formed from a durable cloth material. This base 76 is defined by first and second ends. Furthermore, the retaining element is adapted to secure to rifle-engaging portions. Specifically, a first rifle-engaging portion 78 has its first end 82 sewn into the first end of the base 76 and a second end 84 which has a male snap fastener 86 secured at its distal end. Likewise, a second rifle-engaging portion 88 has its first end 92 sewn into the second end of the base portion 76 and has a female snap fastener 96 secured at its distal second end 94. With continuing the reference to FIG. 7, the base portion 76 has a periphery which is adapted to be sewn to the back of the vest 64 at the lower peripheral extent 72. With the base portion so secured, and the vest 64 on a user, the first and second rifle-engaging portions (78 and 88) can be secured to one another by way of the male and female snap fasteners about the intermediate extent of a rifle. In this manner, the rifle is secured along the back of a user proximate to his or her spine. Although snap fasteners have been disclosed as the preferred embodiment, other fasteners can be employed such as pile-type fasteners and the like.

Although the rifle retaining element 74 has been described for use upon a vest it could readily be employed upon other articles of clothing, such as a coat, shirt or body suit. Furthermore, FIGS. 9–10 illustrate a more sturdy construction of the retaining element. This retaining element 102 is similar in construction to the retaining element 74 in that it consists of two rifle engaging portions 104 and 106. These two portions are adapted to be secured to one another by way of Velcro™ fasteners 108. The heavy duty construction of the retaining element 102 is achieved through a multilayer construction. FIG. 10 is a sectional view showing the layers that compose the structure of the retaining element 102. Specifically, the element includes an outer layer formed from Nylon 112. Additionally, a secondary layer of foam rubber 114 is included in the construction. Finally, the construction incorporates an innermost layer of a flexible plastic insert 116. Such a multilayer construction allows for a durable yet light weight rifle retaining element. As with the previous element, the retaining element 102 is adapted to be secured to the lower back portion of a garment, such as a vest or a body suit. Additionally, the two engaging portions 104 and 106 are adapted to be secured about the butt of a rifle. In this manner, a rifle can be supported along the back of a user wearing the garment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garment specifically adapted for use in supporting a rifle, the garment comprising, in combination:

a vest portion adapted to be secured about the torso-of a user, the vest portion having armholes and a neck opening, the vest having a lower peripheral extent, a front, and a back; and a rifle retaining element comprising a rectangular base formed from a durable cloth material, the base having first and second ends, a first cloth rifle engaging portion having a first end sewn to the first end of the base and a second end having a male snap fastener secured thereto, a second rifle engaging portion having a first end sewn to the second end of the base portion and a second end with a female snap fastener secured thereto, the base portion having a periphery which is adapted to be sewn to the back of the vest at its lower peripheral extent, when so secured on the vest the first and second rife engaging portions are adapted to be secured to one another by way of the female snap fastener and male snap fastener about an intermediate extent of the rifle.

* * * * *